US005379849A

United States Patent [19]

Russell

[11] Patent Number: 5,379,849

[45] Date of Patent: Jan. 10, 1995

[54] HYDRAULIC RAM ASSEMBLIES

[76] Inventor: James B. Russell, 157 Shore Road, Magheramorne, Larne, County Antrim, Great Britain

[21] Appl. No.: 129,169

[22] PCT Filed: Apr. 10, 1992

[86] PCT No.: PCT/GB92/00644

§ 371 Date: Dec. 9, 1993

§ 102(e) Date: Dec. 9, 1993

[87] PCT Pub. No.: WO92/18703

PCT Pub. Date: Oct. 29, 1992

[30] Foreign Application Priority Data

Apr. 10, 1991 [GB] United Kingdom ..... 9107560

[51] Int. Cl.[6] ..... B25D 17/06

[52] U.S. Cl. ..... 173/112; 173/138; 173/211

[58] Field of Search ..... 173/135, 138, 206, 211, 173/112; 91/276, 328

[56] References Cited

U.S. PATENT DOCUMENTS

| | | | |
|---|---|---|---|
| 1,792,888 | 2/1931 | Benedict | 173/112 |
| 1,825,632 | 9/1931 | Kroakovsky et al. | 173/138 |
| 2,899,934 | 8/1959 | Salengro | 173/211 |
| 3,905,428 | 9/1975 | Nishimura et al. | 173/135 |
| 4,056,150 | 11/1977 | Meijer | 173/138 |
| 4,776,408 | 10/1988 | Elkin et al. | 173/211 |
| 5,152,352 | 10/1992 | Mandanis | 173/135 |

*Primary Examiner*—Scott A. Smith

*Attorney, Agent, or Firm*—Edwin E. Greigg; Ronald E. Greigg

[57] ABSTRACT

A hydraulic ram assembly is provided to be used, singly or in multiples, in raising a weighted member, such as a hammer (30) for pile driving, each having means whereby fluid used to extend a respective piston (26) can readily escape to give a sudden release, gravity induced return movement.

24 Claims, 2 Drawing Sheets

FIG. 2
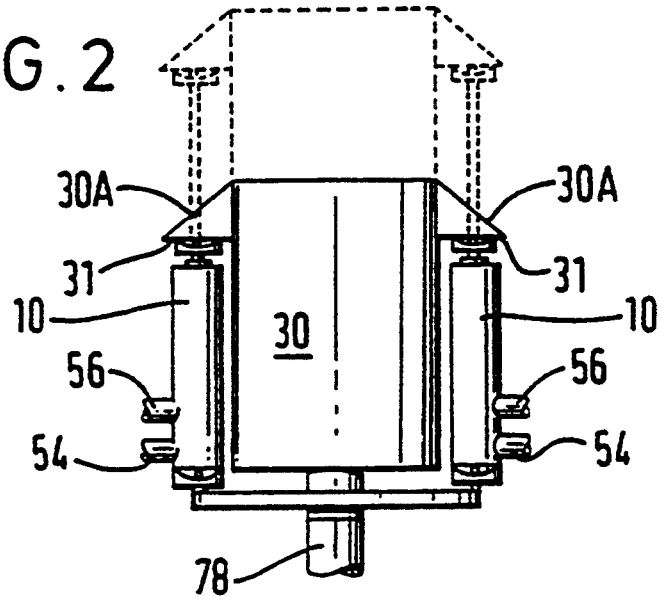
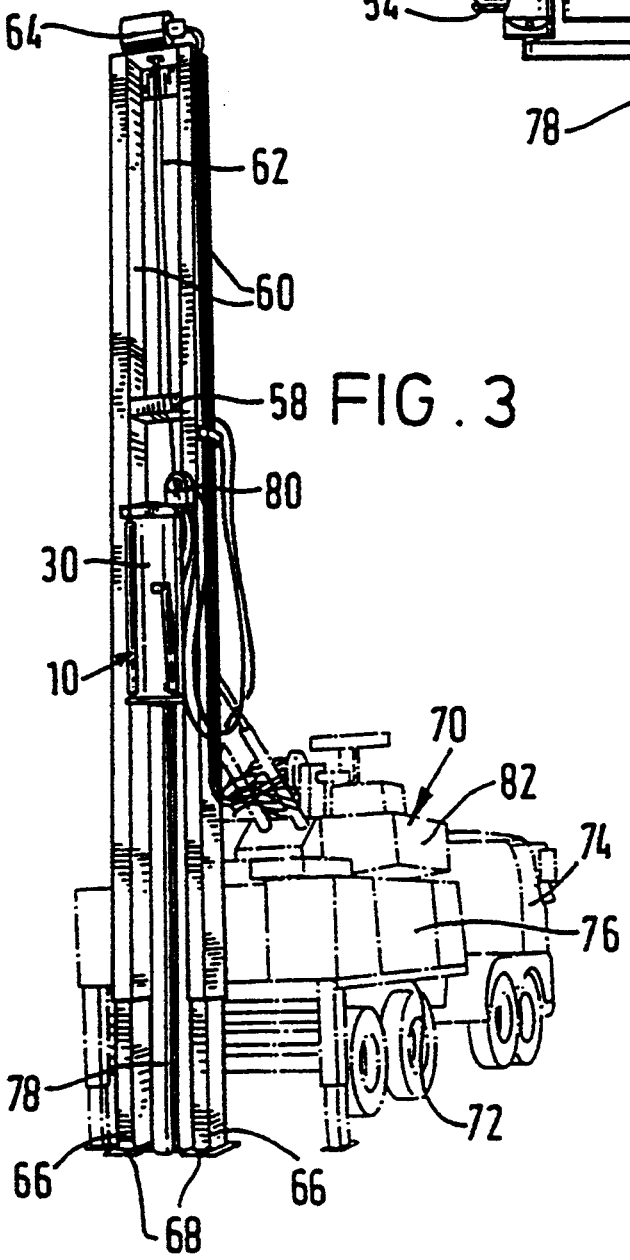
FIG. 3

HYDRAULIC RAM ASSEMBLIES

This invention relates to hydraulic ram assemblies particularly, but not exclusively, for use in hydraulic hammers for driving piles into the ground.

Accordingly, a first aspect of the present invention is a hydraulic ram assembly comprising an outer tubular casing having an apertured end and a closed end, an inner tubular casing extending inwardly into and through the aperture of the apertured end of the outer casing with the outside of the inner casing being made liquidtight with the apertured end, the inner casing having its inner end open and its outer end closed, the inner casing being secured adjacent to its open end to the outer casing, and through the closed end of which a piston rod of a piston is movable longitudinally of the inner casing, a series of ports being provided in the inner casing to enable fluid communication between the insides of the inner and outer casings, the outer end of the piston rod being adapted for a work purpose, a floating piston being provided in the outer casing biased away from the closed end thereof, the floating piston having an axial bore and having secured thereto a formation having an axial passage and a series of axially offset channels, the outer end of the formation adapted to abut and seal against the inner open end of the inner casing, the axial passage housing a floating valve body, the valve body being biased towards and to close off the axial bore at its formation end, at least one fluid inlet being provided at or towards the closed end of the outer casing and at least one fluid outlet being provided in the outer casing at or towards the open end of the inner casing.

Further accordingly, a second aspect of the present invention is a hydraulic hammer comprising an elongate framework having two opposed longitudinal members, means to support the framework in an upright orientation, a hammer tracking the longitudinal members and being for longitudinal movement lengthwise of the framework, and a pair of hydraulic ram assemblies carried in a balanced arrangement about the hammer and adapted to provide a raising movement to the hammer sequentially to each falling movement of the hammer under gravity, each ram assembly being as described in the next preceding paragraph.

A position-adjustable position switch mechanism is preferably provided at the predetermined extent of movement of the distal end of the piston rod of one of the ram assemblies arranged in parallel to permit fluid to escape from or to allow flow of fluid into the ram assemblies respectively.

Preferably, the elongate framework is a carriage mounted between and tracking two masts. The carriage is preferably connected through a flexible element with a winding drum carried at the end of the masts to be uppermost in use. Each mast desirably has a length-extendible foot at the ends intended to be lowermost in use, each foot desirably having a shoe.

Preferably also, the masts are carried on a mobile base unit, and are desirably carried on a platform body of a truck, the base unit having a chassis supported by tyres or tracks.

Preferably further, the end of the floating piston to which the formation is secured, is recessed to form a chamber. The end of the valve body abutting against the bore is desirably of frusto-conical shape. The holes in the wall of the inner casing are preferably spaced from the closed end a distance less than the thickness of the piston head. The piston head is desirably in sealing contact with the inside surface of the inner casing. The floating piston is desirably in sealing contact with the inside surface of the outer casing.

An embodiment of the present invention will now be described, by way of example, with reference to the accompanying drawings, in which:

FIG. 2 is a schematic side view of a hydraulic hammer according to the present invention; and FIG. 3 is a perspective view of a hammer mount on a mobile base unit carried on a truck.

Figure 1:
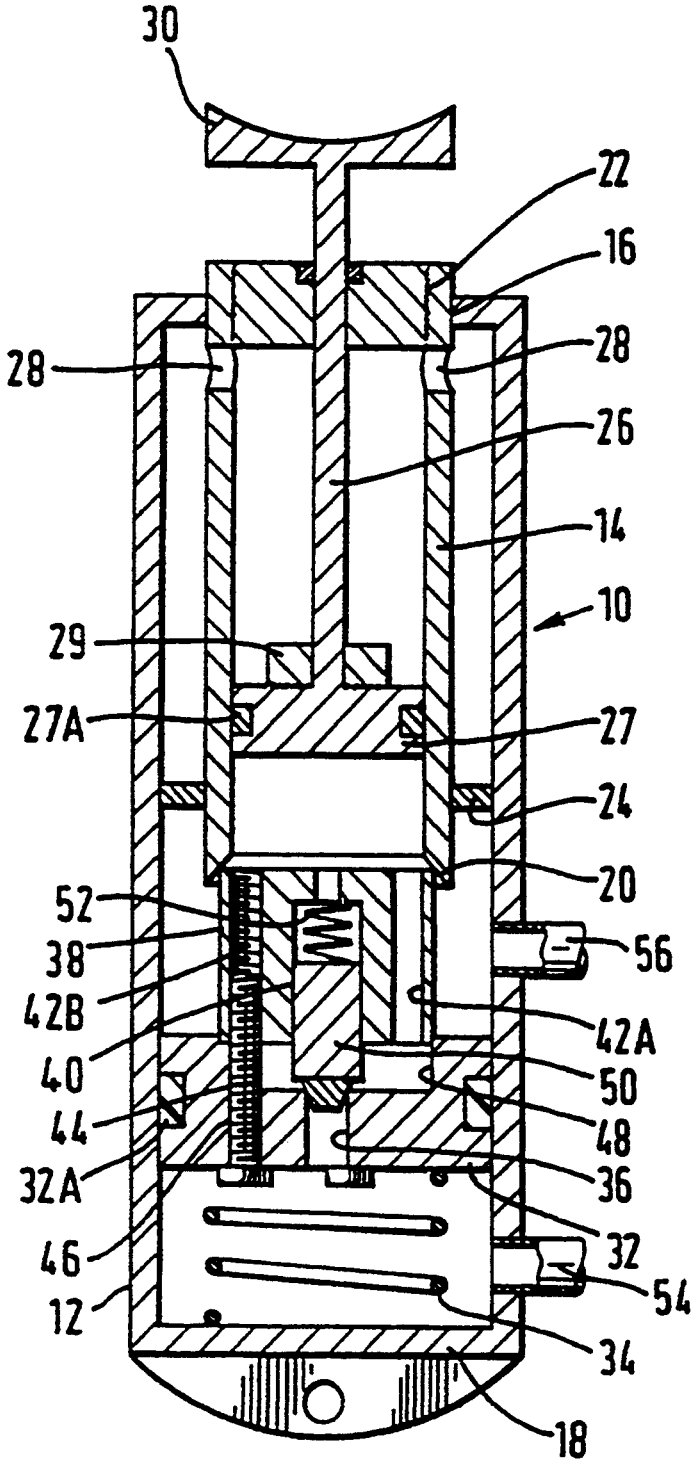
FIG. 1 is a longitudinal cross-sectional view of a hydraulic ram assembly according to the present invention.

Referring to FIG. 1 of the drawings, ram assembly 10 comprises an outer tubular casing 12 and an inner tubular casing 14. The outer tubular casing 12 has an apertured end 16 and a closed end 18. The inner tubular casing 14 extends inwardly into and through the aperture of the apertured end 16 of the outer casing 12 with the outside of the inner tubular casing 14 being made liquidtight with the apertured end 16. The inner casing 14 has its inner end 20 open and its outer end 22 closed. The inner casing 14 is secured by spacers 24 adjacent to its open end 20 to the outer casing 12 and through the closed end 22 of which a piston rod 26 of a piston is movable longitudinally of the inner casing 14. The piston has a piston head 27. The piston head 27 is in sealing contact through seal(s) 27A with the inside surface of the inner casing 14. A series of ports 28 is provided in the inner casing 14 to enable fluid communication between the insides of the inner and outer casings 14, 12. The ports 28 provided radially in the wall of the inner casing 14 are spaced from the closed end a distance less than the thickness of the piston head 27 which is provided with an extension 29 as shown to space the end of the piston head 27 from the outer end and to prevent the seals 27A from closing off the ports 28.

A floating piston 32 is provided in the outer casing 12 biased by a spring 34 away from the closed end 18. The floating piston 32 has an axial bore 36 and has secured thereto a formation 38 having an axial passage 40 and a series of, in this embodiment, six axially offset channels 42A, 42B. Three alternate channels 42A serve as fluid passages and the other three channels 42B are tapped and serve for screw-threaded engagement by bolts 44 which pass through aligned bores 46 provided in piston 32. The outer end of the formation 38 is adapted to abut and seal against the inner open end 20 of the inner casing 14. The end of the floating piston 32 to which the formation 38 is secured, is recessed to form a chamber 48. The axial passage 40 houses a floating valve body 50, the valve body 50 being spring-biased by spring 52 towards and to close off the axial bore 36 as shown. The end of the valve body 50 abutting against the axial bore 36 is of frusto-conical shape. The floating piston 32 is in sealing contact through seal(s) 32A with inside surface of the outer casing 12.

A fluid inlet 54 is provided radially in the wall of the outer casing 12 adjacent to the closed end thereof and a fluid outlet 56 is provided radially in the wall of the outer casing 12 adjacent to the open end of the inner casing 14. The inlet 54 and outlet 56 are provided longitudinally spaced from each other. The fluid inlet 54 and outlet 56 are both integrated into a hydraulic fluid supply circuit.

One application of a ram assembly is with a hydraulic hammer which comprises an elongate framework, in the form of a carriage 58, mounted between and tracking two masts 60. The carriage 58 has two opposed longitudinal members and a hammer 30 tracks these longitudinal members for unrestricted longitudinal movement lengthwise of the carriage 58. Means are provided to support the carriage 58 in an upright orientation, the means comprising the masts 60.

A pair of hydraulic ram assemblies 10 are carried in a balanced arrangement for synchronous movement about the hammer 30 and adapted to provide a raising movement to the hammer 30 sequentially to each falling movement of the hammer 30 under gravity. The outer end of the piston rod 26 of both assemblies 10 carries the hammer 30 through a fixed mounting 30A (FIG. 2) providing a shoulder 31 as shown. The respective piston rod 26 is pivotally connected to the corresponding shoulder 31.

A position-adjustable switch mechanism 80 is provided at the predetermined extent of movement of the distal end of the piston rod 26 of one of the ram assemblies 10, arranged in parallel, to permit fluid to escape from or to allow flow of fluid into the ram assemblies 10 respectively.

The carriage 58 is connected with a first winding drum (not shown) through a flexible element, i.e., cable 62, arranged over a pulley wheel carried at the end of the masts to be uppermost in use. A second winding drum 64 is provided carried at the top end of the masts 60, the winding drum 64 being operated by a hydraulic motor integrated into the hydraulic fluid supply circuit. The winding drum 64 has a second flexible element 80 therearound and is for connection to a pile for lifting and holding steady the pile during operations. Each mast 60 has a length-extendible foot 66, hydraulically operable, at the ends intended to be lowermost in use, each foot 66 having a shoe 68.

The masts 60 are carried on a mobile base unit and are mounted for pivotal movement between a vertical in-use position and a substantially horizontal out-of-use position for travelling. The masts 60 can be adjusted about the vertical position forwardly, backwardly or sideways relative to the base unit to accommodate unlevel ground or to drive the pile(s) into the ground at an angular disposion for particular applications and requirements. The mobile base unit has a chassis supported by tyres, or tracks such as a crawler 70. The mobile base unit is carried on a platform body 72 of a truck 74. Removable sides 76 are provided to be secured .to the body 72. The hydraulic fluid supply circuit can conveniently be provided from such a circuit provided on the crawler 70.

In use, when a pile 78 is to be driven into the ground, the carriage 58 is raised in the masts 60 using cable 62, the second flexible element 80 is connected to an anchorage provided at the top end of a pile to be driven into the ground, and by operation of the second winding drum 64, the pile 78 is erected vertically between the masts 60, the truck 74 and masts 60 are manouvred to correctly position the pile. After the pile is positioned between the masts 60, the carriage 58 is lowered for the hammer head 30 to abut the top of the pile 78. In this position, the hammer 30 is resting at the lowermost position in the carriage 58 under gravitational forces. Hydraulic fluid fills the circuits of both assemblies 10. On energisation, the pump commences to pump fluid from a supply tank 82 into the inlet 54 of each assembly 10, forcing the floating piston 32 and assisting its spring-biasing into abutment and seal against the open end 20 of the inner casing 14, then through axial bore 36 causing the valve body 50 to be displaced from its seat against the bore 36, the fluid then flowing into the chamber 48 and through channels 42A into the open end 20 of the inner casing 14 to force the piston head 27 towards the outer end 22 to lift the hammer 30. As the piston head 27 is moved towards the outer end 22, it forces the fluid in the inner casing 14 through the ports 28 into the annular passage formed between the outer and inner casings 12, 14 and thence to the fluid outlet 56 for recirculation. As soon as the piston head 27 reaches its predetermined upper position and triggers the switch mechanism 80, the pressure at port 54 is released, piston 50 closes aperture 36 by means of spring bias and hydraulic pressure, and the floating piston 32 releases under hydraulic pressure from fluid below piston 27 against its spring-biasing from its seat against the open inner end 20. The gravitational forces of the hammer 30 causes the pistons to be retracted forcing the fluid in front of the piston head to exhaust through its then open end 20 to outlet 56 for recirculation, and to flow in through the ports 28 behind the piston head consequential to this sequence of movements. The fluid is fed in cycles by the operation of the switch mechanisms, which can be open/close valves, whereby when the piston head is at its predetermined stroke, the flow of fluid into the inlet 54 is exhausted allowing the spring biasing to reassert themselves thus closing the valve body 50 against its seat and permitting the unbalanced hydraulic forces to withdraw the floating piston 32 away from the open end 20 of the inner casing 14 as stated above. The cycle of feeding fluid to the assemblies 10 is repeated as often as is required to sink the pile.

In modifications of the hammer, it is not necessary for the foot 66 to be provided with shoes 68, and there may be more or less than six axially offset channels.

Variations and modifications can be made without departing from the scope of the invention described above and claimed hereinafter, for example the means for supporting the framework may be a fork lift arrangement on a traction unit.

I claim:

1. A hydraulic ram assembly, comprising:

an outer tubular casing having an apertured end and a closed end, an inner tubular casing extending inwardly into and through the aperture of the apertured end of the outer casing with an outside of the inner casing being made liquid-tight with the apertured end, the inner casing having its inner end open and its outer end closed an being secured with its open end adjacent the outer casing, a piston rod of a piston being movable longitudinally through the closed end of the inner casing with an outer end of the piston rod being adapted for a work purpose, a series of ports being provided in the inner casing to enable fluid communication between the insides of the inner and outer casings, a floating piston being provided in the outer casing biased away from the closed end thereof, the floating piston having an axial bore and having secured thereto a formation having an axial passage and a series of axially offset channels, the outer end of the formation adapted to abut and seal against the inner open end of the inner casing, the axial passage of said floating piston housing a floating valve body, the valve body being biased towards and to close off the axial bore at its formation end, and at least one fluid inlet being provided at or towards the closed end of the outer casing and at least one fluid outlet being provided in the outer casing at or towards the open end of the inner casing.

2. A ram assembly as set forth in claim 1, which includes a hydraulic hammer comprising an elongate framework having two opposed longitudinal members, means to support the frame work in an upright orientation, a hammer tracking the longitudinal members and being for longitudinal movement lengthwise of the framework, and a pair of hydraulic ram assemblies carried in a balanced arrangement about the hammer and adapted to provide a raising movement to the hammer sequentially to each falling movement of the hammer under gravity.

3. A ram assembly including a hydraulic hammer according to claim 2, wherein, in each ram assembly, the end of the floating piston to which the formation is secured, is recessed to form a chamber.

4. A ram assembly including a hydraulic hammer according to claim 3, wherein, in each ram assembly, the end of the valve body abutting against the bore is of frusto-conical shape.

5. A ram assembly including a hydraulic hammer according to claim 2, wherein, in each ram assembly, the ports in the wall of the inner casing are spaced from the closed end a distance less than the thickness of a piston head of the piston.

6. A ram assembly including a hydraulic hammer according to claim 5, wherein, in each ram assembly, the piston head is in sealing contact with the inside surface of the inner casing.

7. A ram assembly including a hydraulic hammer according to claim 2, wherein, in each ram assembly, the floating piston is in sealing contact with the inside surface of the inner casing.

8. A ram assembly including a hydraulic hammer according to claim 2, wherein a position-adjustable switch mechanism is provided at a predetermined extent of movement of the distal end of the piston rod of one of the ram assemblies arranged in parallel to permit fluid to escape from or to allow flow of fluid into the ram assemblies, respectively.

9. A ram assembly including a hydraulic hammer according to claim 8, wherein the elongate framework is a carriage mounted between and tracking two masts.

10. A ram assembly including a hydraulic hammer according to claim 8, wherein, in each ram assembly, the end of the floating piston to which the formation is secured, is recessed to form a chamber.

11. A ram assembly including a hydraulic hammer according to claim 2, wherein the elongate framework is a carriage mounted between and tracking two masts.

12. A ram assembly including a hydraulic hammer according to claim 11, wherein the carriage is connected through a flexible element with a winding drum carried at the end of the masts to be uppermost in use.

13. A ram assembly including a hydraulic hammer according to claim 12, wherein each mast has a length-extendible foot at the ends intended to be lowermost in use.

14. A ram assembly including a hydraulic hammer according to claim 11, wherein each mast has a length-extendible foot at the ends intended to be lowermost in use.

15. A ram assembly including a hydraulic hammer according to claim 14, wherein each foot has a shoe.

16. A ram assembly including a hydraulic hammer according to claim 11, wherein the masts are carried on a mobile base unit carried on a platform body of a truck, the base unit having a chassis supported by tires or tracks.

17. A ram assembly including a hydraulic hammer according to claim 2, wherein, in each ram assembly, the end of the valve body abutting against the bore is of frusto-conical shape.

18. A ram assembly including a hydraulic hammer according to claim 1, wherein the end of the floating piston to which the formation is secured, is recessed to form a chamber.

19. A ram assembly according to claim 18, wherein the end of the valve body abutting against the bore is of frusto-conical shape.

20. A ram assembly according to claim 1, wherein the end of the valve body abutting against the bore is of frusto-conical shape.

21. A ram assembly according to claim 20, wherein the ports in the wall of the inner casing are spaced from the closed end a distance less than the thickness of a piston head of the piston.

22. A ram assembly according to claim 1, wherein the ports in the wall of the inner casing are spaced from the closed end a distance less than the thickness of a piston head of the piston.

23. A ram assembly according to claim 22, wherein the piston head is in sealing contact with the inside surface of the inner casing.

24. A ram assembly according to claim 1, wherein the floating piston is in sealing contact with the inside surface of the outer casing.

* * * * *